US007508345B2

(12) United States Patent
Pan et al.

(10) Patent No.: US 7,508,345 B2
(45) Date of Patent: Mar. 24, 2009

(54) PIFA ANTENNA ARRANGEMENT FOR A PLURALITY OF MOBILE RADIO FREQUENCY BANDS

(75) Inventors: Patrick Pan, Kamp-Lintfort (DE); Sheng-Gen Pan, Kamp-Lintfort (DE)

(73) Assignee: Qisda Corporation, Taoyuan County (TW)

( * ) Notice: Subject to any disclaimer, the term of this patent is extended or adjusted under 35 U.S.C. 154(b) by 161 days.

(21) Appl. No.: 10/562,182

(22) PCT Filed: May 27, 2004

(86) PCT No.: PCT/EP2004/005751

§ 371 (c)(1),
(2), (4) Date: Dec. 22, 2005

(87) PCT Pub. No.: WO2004/114464

PCT Pub. Date: Dec. 29, 2004

(65) Prior Publication Data

US 2007/0035446 A1 Feb. 15, 2007

(30) Foreign Application Priority Data

Jun. 24, 2003 (DE) ..... 103 28 361

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702, 846, 848

See application file for complete search history.

(56) References Cited

U.S. PATENT DOCUMENTS

| | | | | |
|---|---|---|---|---|
| 6,008,762 | A | 12/1999 | Nghiem | |
| 6,141,539 | A | 10/2000 | Marino | |
| 6,295,030 | B1 | 9/2001 | Kozakai et al. | |
| 6,366,243 | B1 | 4/2002 | Isohatala et al. | |
| 6,545,640 | B1 | 4/2003 | Herve et al. | |
| 6,639,555 | B1 | 10/2003 | Kane et al. | |
| 6,744,410 | B2 * | 6/2004 | Shamblin et al. | 343/702 |

(Continued)

FOREIGN PATENT DOCUMENTS

EP 0 997 974 A1 5/2000

(Continued)

*Primary Examiner*—HoangAnh T Le

(57) ABSTRACT

A small sized structure for a plurality of resonance frequency bands in a PIFA antenna system for at least two mobile frequency bands distant from each other including a ground connection and a HF power supply connection. The PIFA antenna system includes at least two antenna branches which are disposed essentially side-by-side and in parallel to each other in the form of a strip and are connected to each other at a base thereof in order to serially connect the antenna branches which extend at a predetermined distance from each other, thereby forming a slit and are provide with straight segments for producing a capacitance coupling between the branches. The ground connection is preferably arranged at the free end of one of the antenna branches, the HF power supply connection is mounted on the external edge of the branch of the PIFA antenna structure provided with the ground connection. The width of the antenna branches, the length thereof and the slit therebetween are calculated in such a way that the PIFA antenna structure is provided with two resonance frequency bands arranged at a desired distance to each other.

21 Claims, 6 Drawing Sheets

U.S. PATENT DOCUMENTS

| | | | | |
|---|---|---|---|---|
| 2001/0050636 | A1 | 12/2001 | Weinberger | |
| 2003/0058168 | A1 | 3/2003 | Sadler et al. | |
| 2003/0122718 | A1 * | 7/2003 | Fang et al. | 343/702 |
| 2003/0201942 | A1 * | 10/2003 | Poilasne et al. | 343/702 |
| 2004/0056804 | A1 * | 3/2004 | Kadambi et al. | 343/700 MS |
| 2004/0075610 | A1 | 4/2004 | Pan | |
| 2004/0104851 | A1 * | 6/2004 | Kadambi et al. | 343/700 MS |
| 2004/0140938 | A1 * | 7/2004 | Kadambi et al. | 343/702 |

FOREIGN PATENT DOCUMENTS

| | | | |
|---|---|---|---|
| EP | 1 011 167 | A | 6/2000 |
| EP | 1 024 551 | A2 | 8/2000 |
| FR | 2 800 920 | A1 | 5/2001 |
| WO | WO 02/13307 | A1 | 2/2002 |
| WO | WO 02/43182 | A1 | 5/2002 |
| WO | WO 03/069728 | A1 | 8/2003 |

* cited by examiner

PIFA ANTENNA ARRANGEMENT FOR A PLURALITY OF MOBILE RADIO FREQUENCY BANDS

FIELD OF TECHNOLOGY

The present disclosure relates to a PIFA antenna arrangement for at least two mobile radio frequency bands which are separated from one another, having a ground connection and an RF supply connection.

BACKGROUND

One such PIFA antenna arrangement is known, for example, from EP 0 997 974 A1, in which two planar antenna branches are provided, for each of which a common ground connection and a common RF supply connection are provided. The two antenna branches are connected in parallel with one another, and are intended for one resonant frequency in each case. The antenna branches have considerably extended antenna surfaces in each case, so that the PIFA antenna structure requires a large amount of space overall.

SUMMARY

Against this background, the present disclosure is based on providing a PIFA antenna structure for a plurality of resonant frequency bands, and which is designed to be space-saving.

A PIFA antenna arrangement is disclosed for at least two mobile radio frequency bands, which are separated from one another, having a ground connection and an RE supply connection, in which the PIFA antenna arrangement has at least two antenna branches, which run parallel to one another (i.e., essentially alongside one another) and are previously in the form of strips and are connected to one another at a foot portion in order to connect the antenna branches in series. The antenna branches run at a predetermined distance from one another in order to form a gap, the antenna branches have straight sections in order to produce capacitive coupling between the antenna branches the ground connection is preferably arranged at a free end of one of the antenna branches where the RF supply connection is arranged at the outer edge of the antenna branch of the PIFA antenna structure, at which the ground connection is provided. The widths of the antenna branches, the lengths of the antenna branches and the gap between the antenna branches are preferably of such a size that the PIFA antenna structure has two resonant frequency bands with a desired separation from one another.

A structure such as this for a PIFA antenna arrangement allows a transmission characteristic and a reception characteristic to be produced for two different mobile radio frequency bands. The major parameters for setting the desired resonant frequency bands are the widths, the lengths and the width of a gap between the antenna branches. In detail, the ratio between the areas of the two antenna branches and the ratio between the widths of the two antenna branches corresponds, to a rough approximation, to the ratio between the two resonant frequency bands. The ratio between the positions of the two resonant frequency bands in a frequency spectrum can likewise be influenced by varying the width of the gap. Accordingly, a PIFA antenna structure may be optimized for specific application requirements by modification of the two ratios that have been mentioned, and the width of the gap, in which case it is possible to set not only the position of the two resonant frequency bands, but also their bandwidth.

The width of one antenna branch is preferably less than 1/15 of the wavelength of the higher-frequency frequency band. This has the advantage that the antenna branch is narrow, so that the overall volume of the antenna becomes smaller. Furthermore, there is stronger coupling between the antenna branches. In addition, the ratio between the first and the second resonant frequency can be changed more easily. It is particularly preferable for the width of one antenna branch to be less than 1/20 of the wavelength of the higher-frequency frequency band.

The magnitude of the distance between the ground connection and the RF supply connection should preferably be matched to one of the resonant frequencies, specifically the higher resonant frequency, in order to define the higher-frequency frequency band. In most cases, there is a fixed ratio between the distance between the ground point and the RF supply connection and the (mid-) wavelength of the higher-frequency resonant frequency band.

In general, the two antenna branches run over essentially the same length to the foot portion. However, it is also possible for one of the two antenna branches to have a length which differs from the length of the other antenna branch, for example by being greater or less than it. In this case, care should be taken to ensure that the inductive and capacitive coupling between the two antenna branches is in the desired orders of magnitude, which are important for the respective bandwidth of the resonant frequency bands.

It is likewise possible to provide for the predetermined distance between the two antenna branches not to be constant but to have a predetermined profile in the area in which the antenna branches run alongside one another.

It is also possible for the antenna branches which run alongside one another to have common bends, thus increasing the inductive coupling between the two antenna branches. A measure such as this can be adopted when the PIFA antenna structure has to be accommodated in a particularly space-saving manner, for example in the housing of a mobile telephone.

Under an exemplary embodiment, PIFA antenna arrangement has two antenna branches which run substantially parallel to one another, at least in places, and disclosed are in the form of strips. The branches are connected to one another at a second foot portion in order to connect the two further antenna branches in series with one another, the further antenna branches running in a predetermined distance from one another over one section in order to form a gap, the further antenna branches have straight sections in order to produce capacitive coupling between the antenna branches, and the ground connection is arranged between the antenna branches and the further antenna branches. A further supply connection is arranged at the outer edge of the antenna branches of the PIFA antenna structure, at which the ground connection is provided, and the widths of the further antenna branches, the lengths of the further antenna branches and the gap between the further antenna branches are of such a size that the PIFA antenna structure has two further resonant frequency bands with the desired separation from one another.

The exemplary embodiment represents a combination of two substantially identical PIFA antenna arrangements the aforementioned structure. The extended PIFA antenna arrangement is thus able to receive and transmit in four different resonant frequency bands. To this extent, the embodiment provides a so-called "quad-band antenna structure", which is of particular interest at the moment for the development of antenna structures which can be used for standard international mobile radio frequency ranges (GSM850, EGSM900, PCN1800 and PCS1900).

It is preferable for the RF supply connection and the further RF supply connection to be arranged on opposite sides of the ground connection, and to be joined together to form a common RF supply line.

BRIEF DESCRIPTION OF THE DRAWINGS

The various objects, advantages and novel features of the present disclosure will be more readily apprehended from the following Detailed Description when read in conjunction with the enclosed drawings, in which.

DETAILED DESCRIPTION

Figure 1:
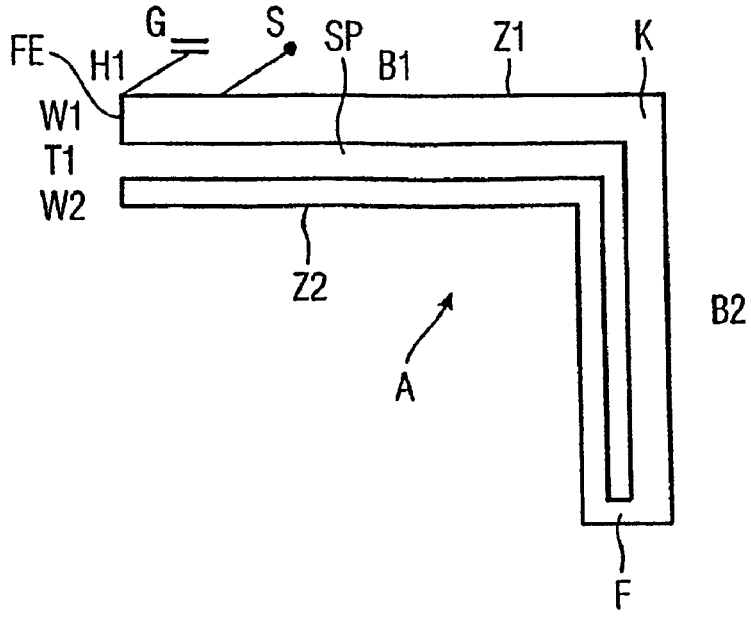
FIG. 1 illustrates a plan view of a PIFA antenna arrangement with two antenna branches, according to a first exemplary embodiment of the invention.

FIG. 1 illustrates a folded PIFA arrangement (F-PIFA) which is generally L-shaped for compactness reasons. The PIFA antenna arrangement has two antenna branches Z1, Z2, with the first antenna branch Z1 having a first width W1, and the second antenna branch Z2 having a second width W2. The two antenna branches Z1, Z2 are connected in series and are connected to one another at a foot portion F. In addition, they run substantially parallel to one another, and alongside one another. The PIFA antenna arrangement shown in FIG. 1 is also characterized by the external dimensions of the antenna branch Z1, specifically a first length B 1 between a free end and bend point K in the L shape, and a second length B2 between the bend point K and the foot portion F.

A gap SP with a width T1, which remains essentially constant over the lengths of the antenna branches Z1, Z2, is defined between the two antenna branches Z1, Z2.

A ground connection G is provided at a free end FE of the first antenna branch Z1, to be precise at the outer edge of the first antenna branch Z1, facing away from the gap SP. An RF supply connection S for RF signals is provided on the first antenna branch Z1, at a distance from the ground point G. The distance between the ground point G and the RF supply connection S is optimized for one of two resonant frequencies of the PIFA antenna structure. The PIFA antenna arrangement illustrated in FIG. 1 is arranged at a distance H1 from a circuit board (not illustrated), on which contact is also made with the ground connection G and the RF supply connection S.

The following parameters are of particular importance for the ratio between the frequency of the first resonant frequency band and of a second resonant frequency band of the PIFA antenna structure: the ratio of the areas of the first antenna branch Z1 and of the second antenna branch Z2, the width T1 of the gap SP and the distance between the ground point G and the RF supply connection S. Primarily, the three parameters mentioned above must be matched for optimization of the PIFA antenna arrangement for a desired frequency spectrum with two resonant frequency bands, and this can be carried out by a person skilled in the art, by simple experiments.

Figure 2:
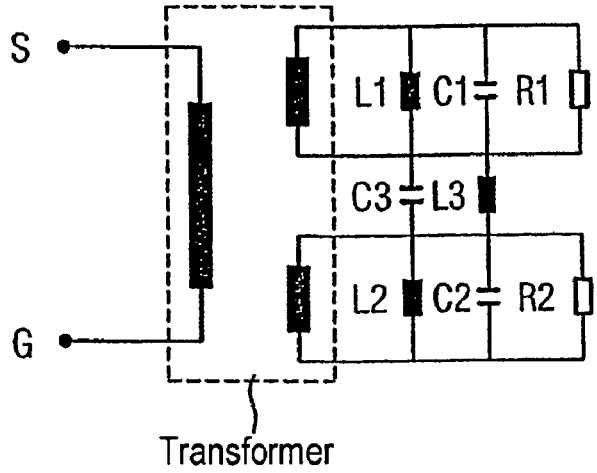
FIG. 2 illustrates an equivalent circuit of the PIFA arrangement shown in FIG. 1.

FIG. 2 shows an equivalent circuit of the PIFA antenna arrangement shown in FIG. 1. The first antenna branch Z1 is represented in FIG. 2 by a first inductance L1, a first capacitance C1 and a first non-reactive resistance R1, while the second antenna branch Z2 is reproduced by a second inductance L2, a second capacitance C2 and a second non-reactive resistance R2. Coupling between the first antenna branch Z1 and the second antenna branch Z2 is represented by a third capacitance C3 and a third inductance L3. In this case, the magnitude of the third capacitance C3 depends primarily on straight sections of the two antenna branches Z1, Z2, running alongside one another, or else on the width T1 of the gap SP. In contrast, the inductive coupling between the two antenna branches Z1, Z2, which is represented by the third inductance L3, is governed by curved sections of the two antenna branches Z1, Z2, alongside one another. In the present exemplary embodiment, a first curved section occurs in the area of the bend point, while a second curved section is provided by the foot portion. The inductive coupling between the two antenna branches Z1, Z2 is particularly strongly pronounced in these two areas.

Furthermore, FIG. 2 shows the ground connection G and the RF supply connection S. A signal between these two connections is coupled to the two antenna branches Z1, Z2 by means of a transformer.

Figure 3:
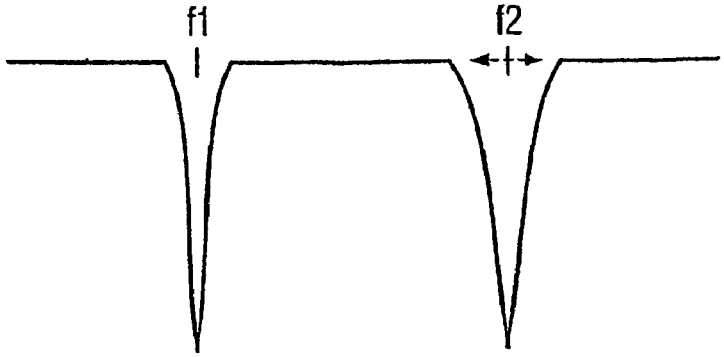
FIG. 3 illustrates a schematic representation of a frequency spectrum of the PIFA arrangement shown in FIG. 1.

FIG. 3 shows a typical frequency spectrum for the PIFA antenna arrangement, as has been explained with reference to FIG. 1. The frequency spectrum has two resonant frequency bands, which are annotated f1 and f2 in FIG. 3. The value of f1 is governed essentially by the distance between the ground connection G and the RF supply connection S. The precise position of the resonant frequency band for the frequency f2 depends on the ratio between the areas/widths W1, W2 of the two antenna branches Z1, Z2 and the width T1 of the gap SP. For given lengths B1, B2, the area ratio between the two antenna branches Z1, Z2 can thus be modified by variation of the width ratio W1/W2, in order to achieve a desired position for the second resonant frequency band for the frequency f2.

Figure 4:
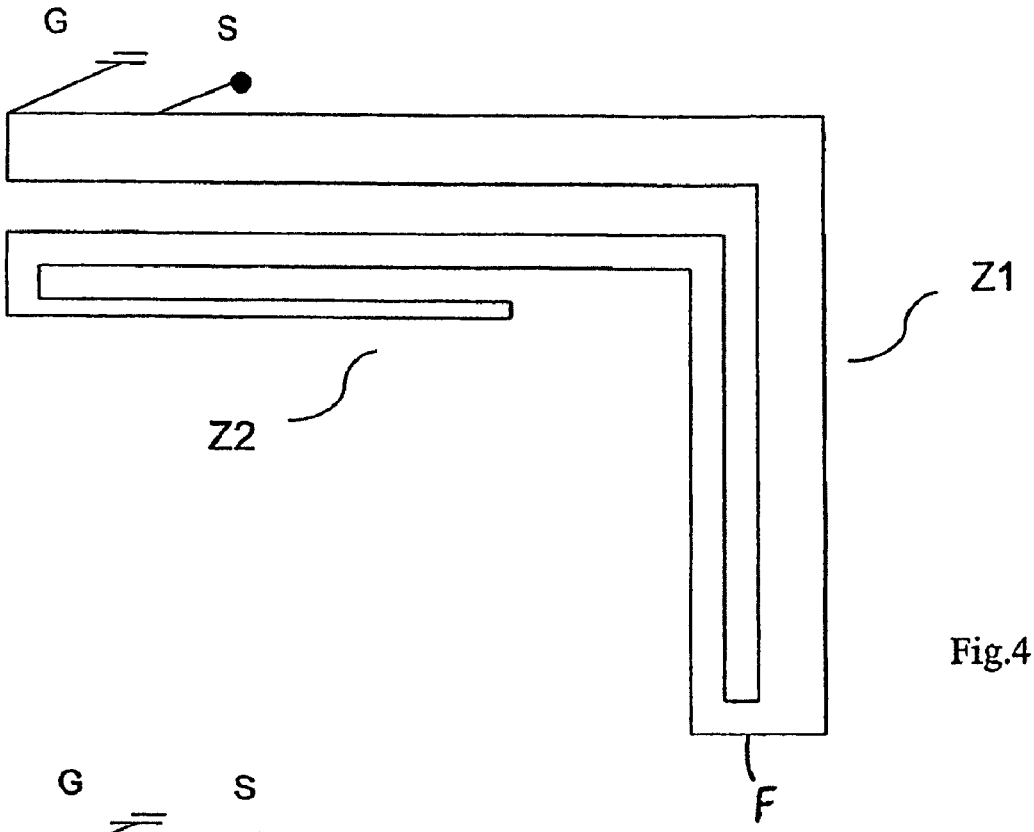
FIG. 4 illustrates a plan view of a PIFA antenna arrangement according to a second exemplary embodiment.

FIGS. 4 to 7 show three modified embodiments of the PIFA antenna arrangement shown in FIG. 1. In the embodiment which is illustrated in FIG. 4, the antenna branch Z2 has a reversal point at approximately the same level as the ground connection G. Two sections of the antenna branch Z2 are located essentially parallel to one another from this reversal point.

Figure 5:
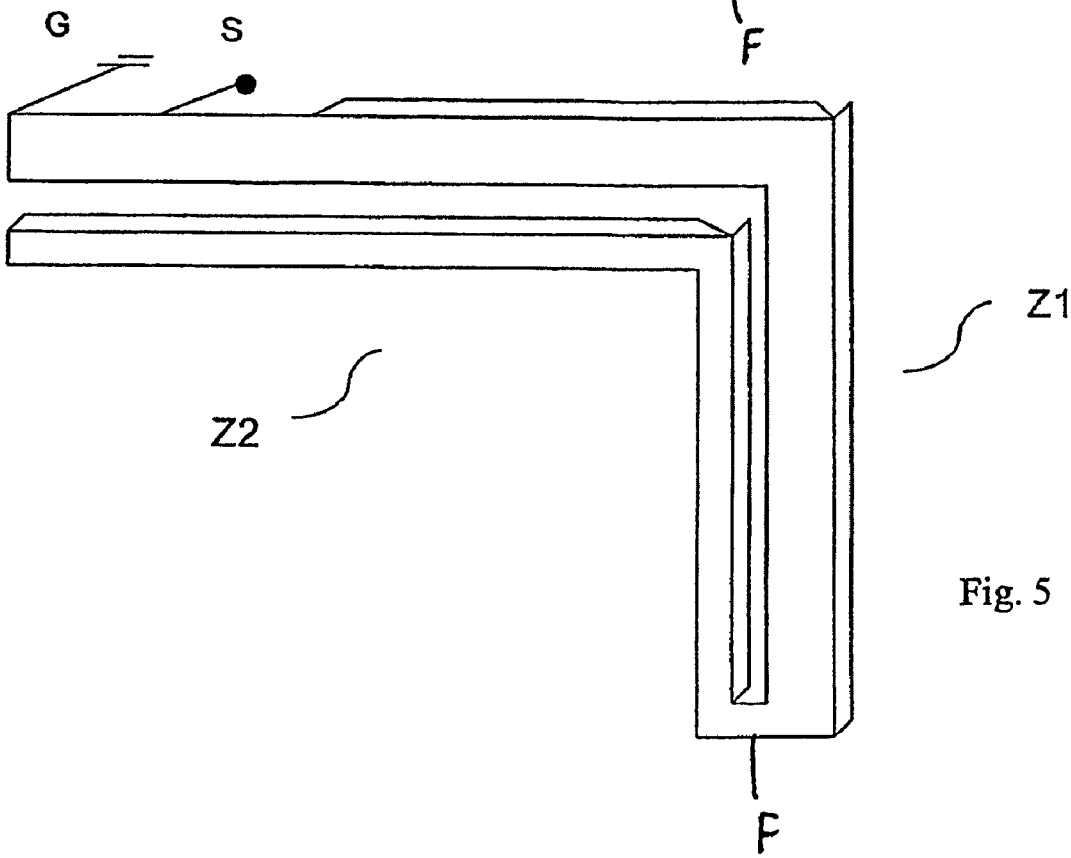
FIG. 5 illustrates a plan view of a PIFA antenna arrangement according to a third exemplary embodiment.

The difference between the PIFA antenna structure shown in FIG. 1 and that shown in FIG. 5 is that the antenna branches Z1, Z2 are three-dimensional.

Beyond the RF supply connection S, the antenna branch Z1 has a cross section which is essentially right-angled. This also applies to the antenna branch Z2.

Figure 6:
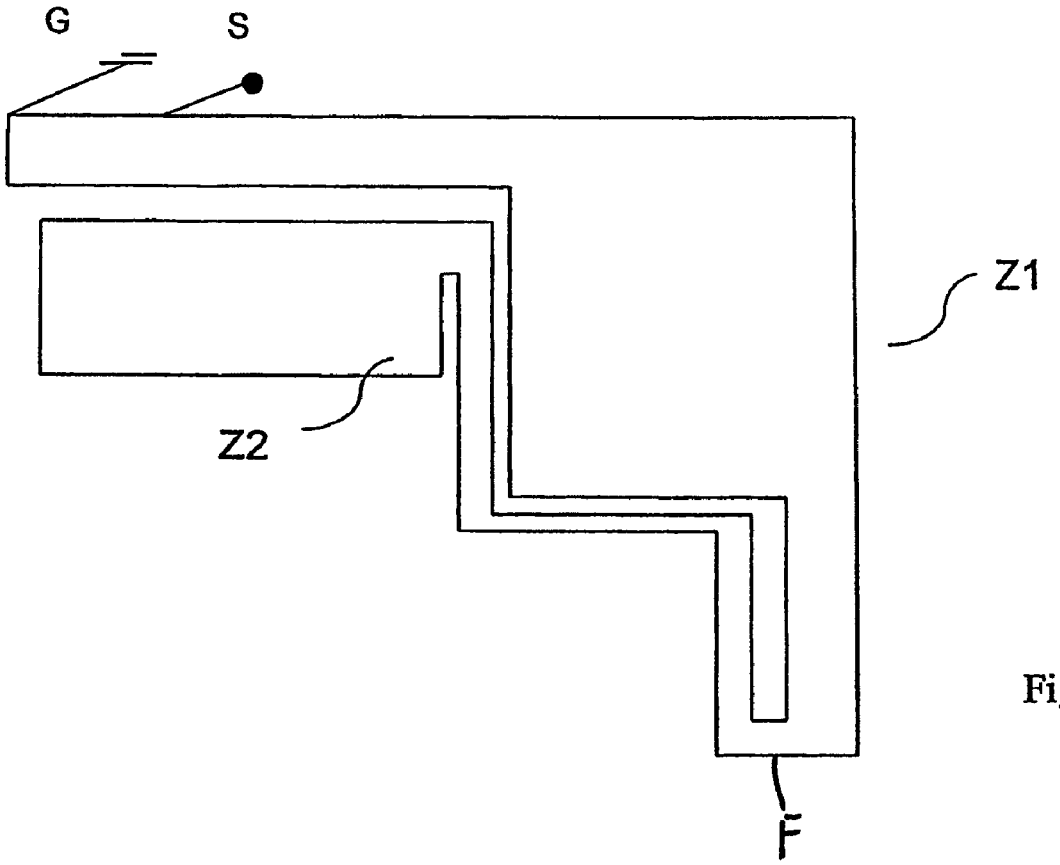
FIG. 6 illustrates a plan view of a PIFA antenna arrangement according to a fourth exemplary embodiment.

The embodiment shown in FIG. 6 of a PIFA antenna arrangement is distinguished by the two antenna branches Z1, Z2 not being in the form of elongated elements, but by their width or general structure varying, starting from the foot portion F. In particular, the width W1 of the first antenna branch Z1 as well as the width W2 of the second antenna branch Z2 vary, in each case from the foot portion F to the opposite end of the relevant antenna branch Z1, Z2.

Figure 7:
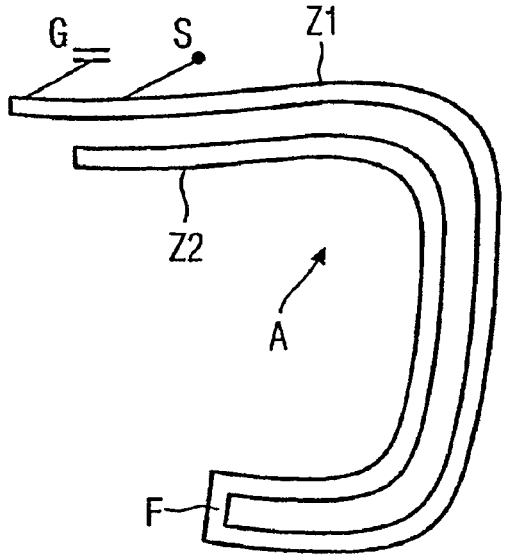
FIG. 7 illustrates a plan view of a PIFA antenna arrangement according to a fifth exemplary embodiment.

The further embodiment of a PIFA antenna arrangement as illustrated in FIG. 7 is a generalized example wherein the external shape of the PIFA antenna arrangement is comparatively irregular. As can be seen from figure 7, it is sufficient for the functionality of the PIFA antenna structure for the two antenna branches Z1, Z2 to run approximately alongside one another and parallel to one another. The respective overall lengths of the antenna branches Z1, Z2 may also differ from one another. In comparison to the PIFA antenna arrangement shown in FIG. 1, the PIFA antenna arrangement shown in FIG. 7 has two curved areas for the two antenna branches Z1, Z2, thus increasing the inductive coupling between the two antenna branches Z1, Z2 in comparison to the PIFA antenna arrangement shown in FIG. 1. The PIFA antenna arrangement shown in FIG. 7 also has the foot portion F, at which the first antenna branch Z1, which originates from the ground connection G, is connected to the second antenna branch Z2, in the form of a series circuit.

Two frequency spectra (reflection spectra) of PIFA antenna arrangements will be explained with reference to FIGS. 8 and 9 which correspond to the embodiment disclosed in FIG. 1. The graphs in each case show the magnitude |S11| as a function of the frequency in MHz.

The parameters of the PIFA antenna arrangement shown in FIG. 1 were chosen to be as follows in order to obtain the frequency spectrum shown in FIG. 8:

W1=W2=T1=2 mm, B1=36 mm, B2=14 mm, H1=6 mm.

This means that the PIFA antenna structure has a volume of 1.58 cm3, which means a very compact structure.

Figure 8:
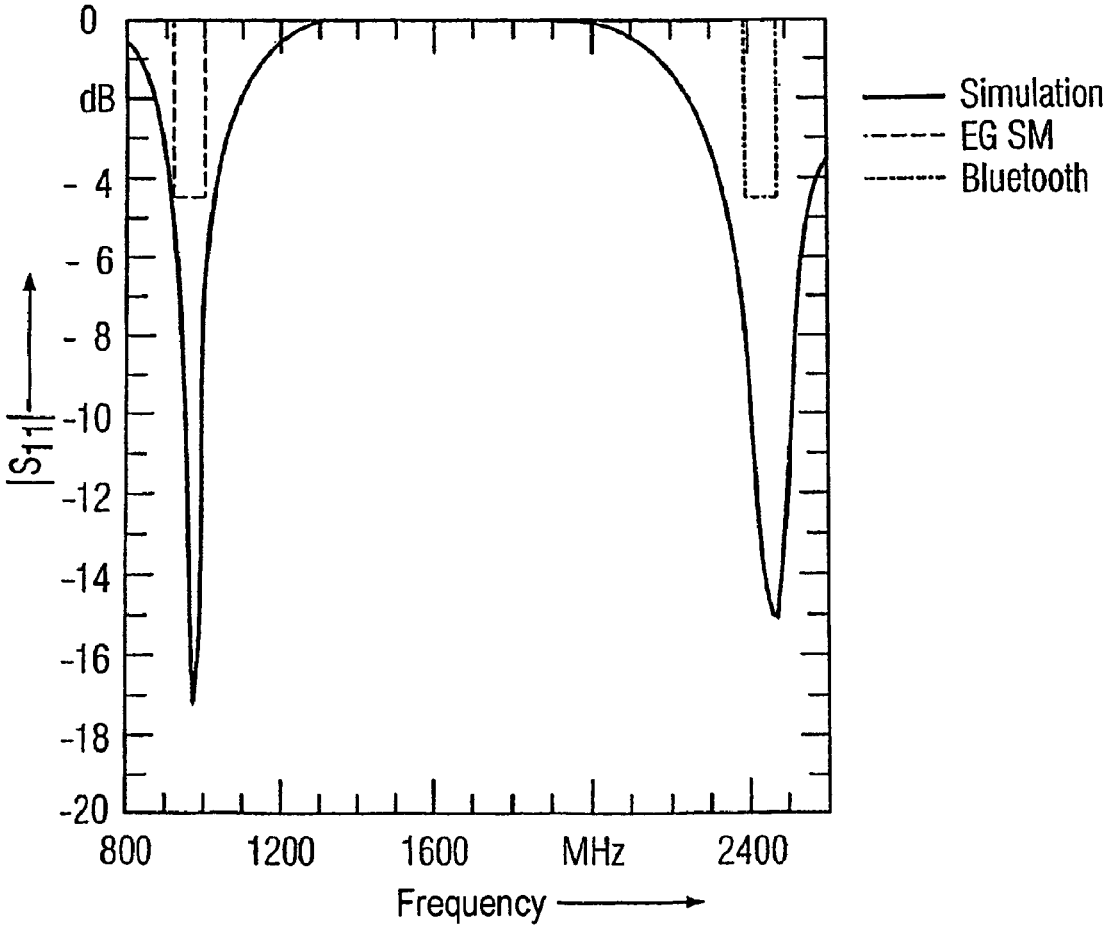
FIG. 8 is a graph illustrating a simulation result for the frequency response of the PIFA antenna arrangement shown in FIG. 1, optimized for the EGSM900 and Bluetooth frequency bands.

The choice of the parameters in the manner mentioned above results in the frequency spectrum shown in FIG. 8, which has pronounced resonant frequency bands both in the EGSM900 frequency range and in the Bluetooth frequency range. To this extent, the PIFA antenna structure is matched for transmission and reception of signals from the two standard mobile radio frequency ranges.

Figure 9:
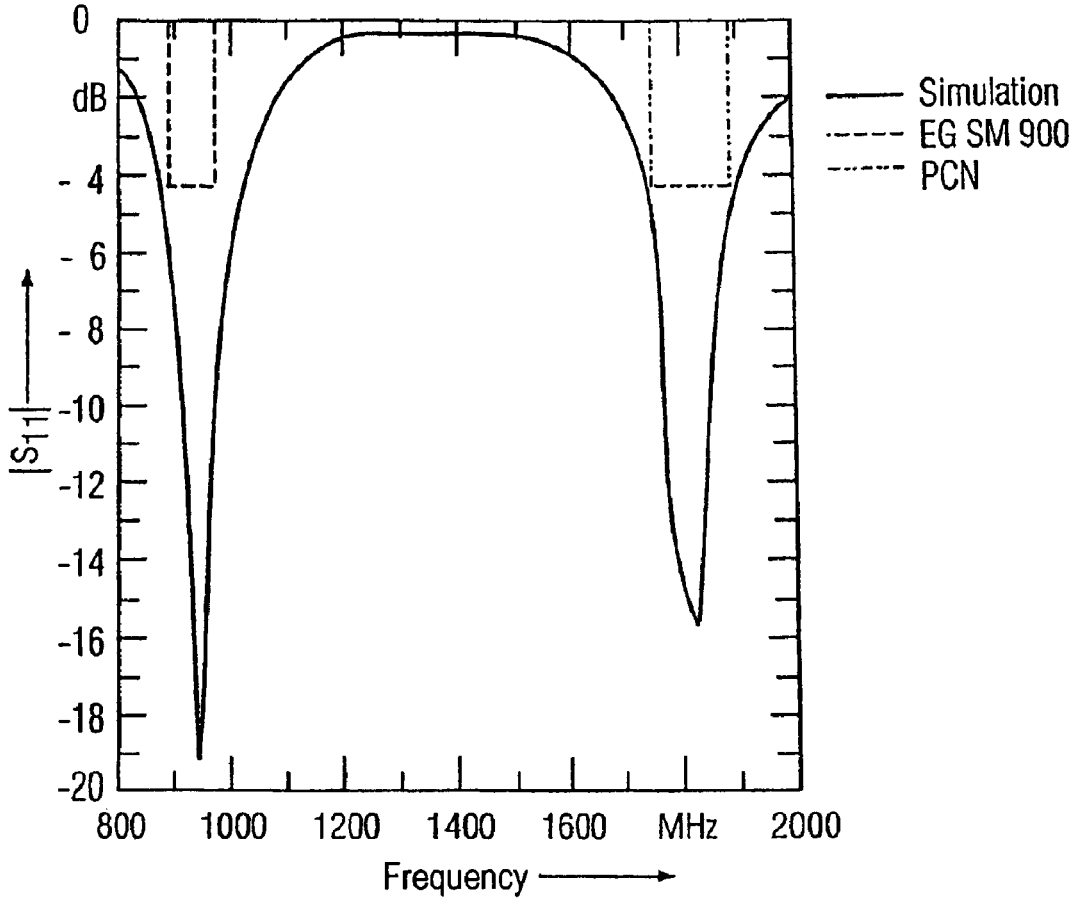
FIG. 9 is a graph illustrating a simulation result for the frequency spectrum of the PIFA antenna arrangement shown in FIG. 1, optimized for the EGSM900 and PCN1800 frequency bands.

The frequency spectrum shown in FIG. 9 is likewise based on a PIFA antenna arrangement of the type shown in FIG. 1. The relevant parameter magnitudes are as follows:

W1=4, W2=T1=2 mm, B1=36 mm, B2=18 mm, H1=7 mm.

This results in an antenna volume of 2.94 cm3, which is somewhat greater than that in the previous example. A PIFA antenna structure such as this has resonant frequency bands for the EGSM900 and PCN1800 standard mobile radio frequency ranges, as can be seen directly from FIG. 9.

For illustrative purposes, FIGS. 8 and 9 show the positions of the relevant standard mobile radio frequency ranges separately in the form of a dashed-dotted line or dashed line.

Figure 10:
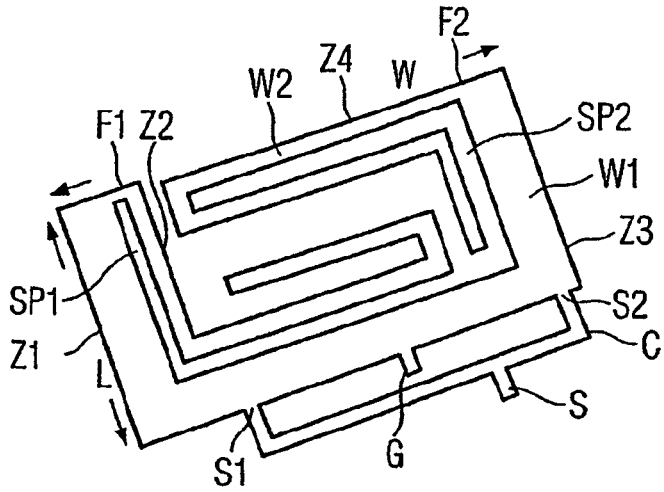
FIG. 10 illustrates a perspective view of a PIFA antenna arrangement according to a sixth exemplary embodiment.

Another exemplary embodiment of a PIFA antenna arrangement with an essentially rectangular outer edge is shown in FIG. 10. The PIFA antenna arrangement is designed to transmit and receive in a total of four different standard mobile radio frequency ranges. With regard to the designation of components and parameters for the PIFA antenna arrangement illustrated in FIG. 10, the same reference symbols are used for components and parameters with the same effect as in FIG. 1.

Fundamentally, the PIFA antenna arrangement shown in FIG. 10 corresponds to a combination of two PIFA antenna arrangements as shown in FIG. 1, with the ground connection G defining a junction point between the two PIFA antenna arrangements.

The PIFA antenna arrangement illustrated in FIG. 10 has two pairs of antenna branches, specifically a first pair Z1, Z2 and a second pair Z3, Z4. In this case, the antenna branches Z3, Z1 are connected to the ground connection G, with their "free ends" coinciding.

The third exemplary embodiment of the PIFA antenna structure has two foot portions F1, F2, which are defined as follows: the two antenna branches Z1, Z2 together describe a general U-shape, whose free ends govern the positions of the foot portions F1, F2. In this case, the width W1 of the antenna branches Z1, Z3 is the same. In alternative exemplary embodiments, these widths may also differ from one another.

The antenna branches Z2, Z4 are located in the interior of the general U-shape which is described by the antenna branches Z1, Z3. The antenna branch Z2 runs from the foot portion F1 parallel to and alongside the antenna branch Z1, extends by a specific distance beyond the ground connection G, and is bent back in the final section, so that the antenna branch Z2 is partially folded. The antenna branch Z4 originates from the foot portion F2, but first of all runs essentially at right angles to a straight section of the antenna branch Z3 that is adjacent to the foot portion point-F2. As soon as the antenna branch Z4 has reached a predetermined distance from the opposite antenna branch Z2, it is folded back and runs alongside its initial straight section. As soon as the antenna branch Z4 has reached a predetermined distance, specifically the width T of a gap SP1 between the antenna branch Z3 and the antenna branch Z4, it runs alongside and parallel to the antenna branch Z3.

The antenna branches Z2, Z4 have the same width W2. In alternative embodiments, these widths of the antenna branches Z2, Z4 may also differ from one another. A PIFA antenna structure element formed by the antenna branches Z1, Z2 has a gap SP2 whose width corresponds to the width T. The gap widths between the two PIFA antenna structure elements may, of course, also be different. The widths of the respective gaps SP1 and SP2 are governed by sections of mutually associated antenna branches running alongside one another in parallel, such as Z3 and Z4, as well as Z1 and Z2.

The PIFA antenna structure shown in FIG. 10 has a common (not illustrated) RF excitation circuit, which is formed on a circuit board (not illustrated). The PIFA antenna structure is at a distance H1 from the circuit board and has two RF supply connections S1, S2, of which the supply connection S1 is associated with the antenna branch pair Z1, Z2, and the RF supply connection S2 is associated with the antenna branch pair Z3, Z4. The two RF supply connections S1, S2 are joined together to form a common RF supply connection S, so that the same excitation signals are available for the PIFA antenna structure at the locations defined by the RF supply connections S1, S2.

With regard to capacitive and inductive coupling, the antenna branches Z1, Z2, Z3 and Z4 behave in a similar way to the antenna branches Z1, Z2 shown in FIG. 1.

Figure 11:
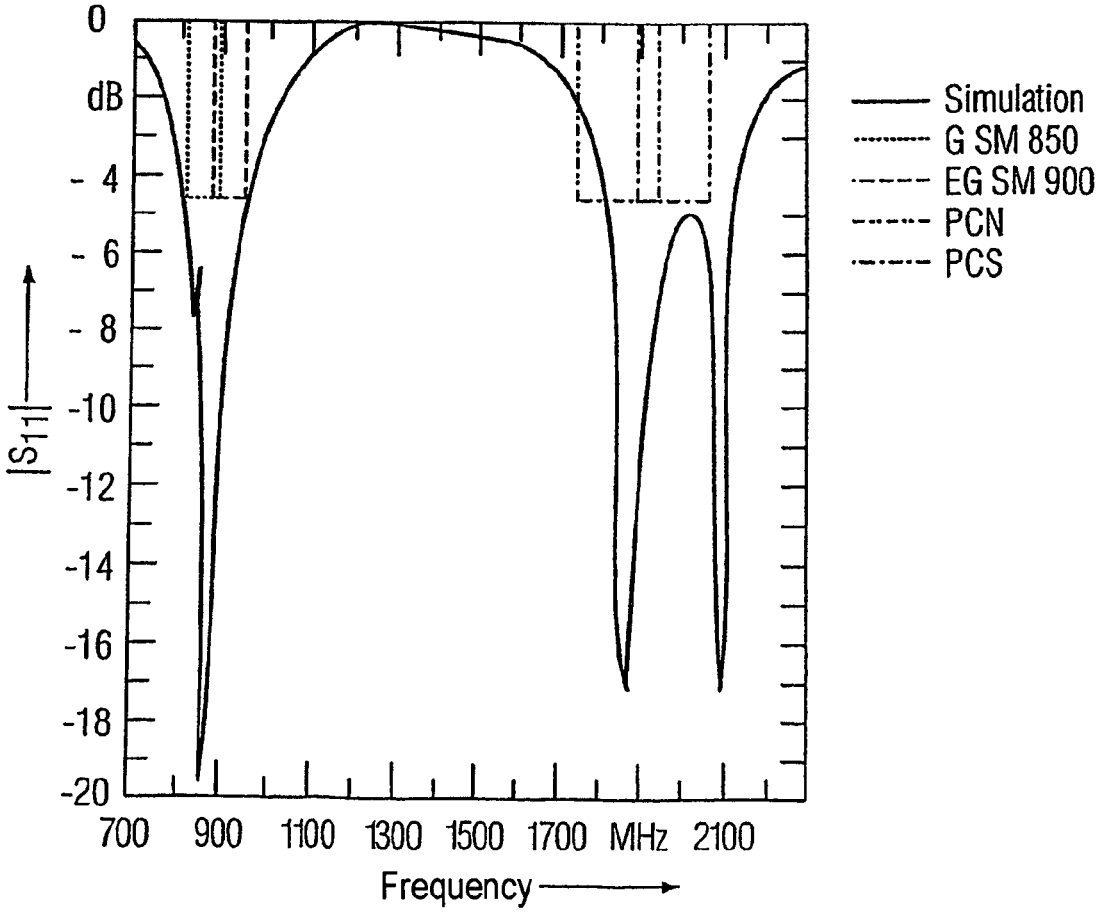
FIG. 11 is a graph illustrating the frequency response of the PIFA antenna arrangement shown in FIG. 7.

FIG. 11 shows a frequency spectrum of the PIFA antenna structure as shown in FIG. 10, with predetermined values for the major parameters. These values are chosen as follows:

W1=3 mm, W2=2 mm, T=1 mm.

The overall width of the PIFA antenna structure is 36 mm, and the overall length of the PIFA antenna structure is 24 mm. This results in an antenna volume of 6.0 cm3. The distance H1 between the circuit board and the PIFA antenna structure is 7 mm. The spatial position of the four antenna branches (Z1, Z2, Z3 and Z4) is in each case evident from FIG. 10, which was discussed above.

As is evident from the frequency spectrum shown in FIG. 11, the PIFA antenna arrangement has resonant frequency bands for the GSM850, EGSM900, PCN1800 and PCS1900 standard mobile radio frequency ranges, thus providing a so-called "quad-band" antenna. The frequency spectrum shown in FIG. 11 is also a simulated spectrum.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention claimed is:

1. A PIFA antenna arrangement for at least two mobile radio frequency bands having a desired separation from one another comprising:

a first antenna branch having a first section, a second section, a foot portion, and a first turning point, wherein the second section is connected to the first section and the foot portion, and the first turning point is located between the first and second sections;

a second antenna branch being alongside the first antenna branch and having a third section, a fourth section, and a second turning point, wherein the first antenna branch and the second antenna branch are in the form of strips and connected at the foot portion of the first antenna branch to form a series connection, the first section is parallel to the third section, the second section is parallel to the fourth section, a first gap is formed between the first and third sections, a second gap is formed between the second and fourth sections, and the first gap equals the second gap;

a ground connection, arranged at an outer edge of the first antenna branch facing away from the first gap; and an RF supply connection is arranged at the outer edge of the second end of the first antenna branch where the ground connection is provided;

wherein the widths of the first antenna branch and the second antenna branch, the lengths of the first antenna branch and the second antenna branch, and the gaps between the first antenna branch and the second antenna branch are of such a size that the PIFA antenna structure has two resonant frequency bands that conform to the desired separation.

2. The PIFA antenna arrangement as claimed in claim 1, wherein the width of at least one of the first antenna branch and the second antenna branch is less than 1/15 of the wavelength of a higher-frequency frequency band.

3. The PIFA antenna arrangement as claimed in claim 2, wherein the width of at least one of the first antenna branch and the second antenna branch is less than 1/20 of the wavelength of the higher-frequency frequency band.

4. The PIFA antenna arrangement as claimed in claim 1, wherein a distance between the ground connection and the RF supply connection is matched to a resonant frequency of one of the two resonant frequency bands.

5. The PIFA antenna arrangement as claimed in claim 1, wherein the area ratio of the first antenna branch and the second antenna branch corresponds to a ratio between two resonant frequencies.

6. The PIFA antenna arrangement as claimed in claim 1, further comprising:

a third antenna branch;

a fourth antenna branch being alongside the third antenna branch, wherein the third antenna branch and the fourth antenna branch are in the form of strips and the third antenna branch and the fourth antenna branch are connected in series at a second foot portion, the fourth antenna branch having a third gap with the third antenna branch, wherein the first antenna branch connects to the third antenna branch at the ground connection.

7. The PIFA antenna arrangement as claimed in claim 6, further comprising:

a further RF supply connection is arranged at an outer edge of the third antenna branch where the ground connection is provided.

8. The PIFA antenna arrangement as claimed in claim 7, wherein the RF supply connection and the further RF supply connection are joined together to form a common RF supply line.

9. The PIFA antenna arrangement as claimed in claim 6, wherein the arrangement has a substantially rectangular outer edge.

10. A PIFA antenna comprising:

a first antenna branch having an L-shape;

a second antenna branch having an L-shape, the second antenna branch being alongside the first antenna branch, and the second antenna branch having a first gap with the first antenna branch, wherein the second antenna branch is connected to a first end of the first antenna branch to form a series connection and the first gap is in an L-shape;

a ground connection set near a second end of the first antenna branch; and an RF supply connection, wherein the ground connection and the RF supply connection are arranged at an outer edge of the first antenna branch facing away from the first gap.

11. The PIFA antenna as claimed in claim 10, the first antenna branch further comprising a foot portion for connecting the second antenna branch, wherein a length of the foot portion is substantially equal to the gap.

12. The PIFA antenna as claimed in claim 10, further comprising:

a third antenna branch having an L-shape;

a fourth antenna branch having an L-shape, the fourth antenna branch being alongside the third antenna branch, wherein the third antenna branch and the fourth antenna branch are connected in series at a second foot portion, the fourth antenna branch having a third gap with the third antenna branch, wherein the first antenna branch connects to the third antenna branch at the ground connection.

13. The PIFA antenna as claimed in claim 12, further comprising:

a further RF supply connection is arranged at an outer edge of the third antenna branch where the ground connection is provided.

14. The PIFA antenna as claimed in claim 13, wherein the RF supply connection and the further RF supply connection are joined together to form a common RF supply line.

15. The PIFA antenna as claimed in claim 10, wherein a free end of the second antenna branch and the second end of the first antenna branch forms an opening of the first gap.

16. The PIFA antenna as claimed in claim 10, wherein the RF supply connection is set between the ground connection and the first end of the first antenna branch.

17. The PIFA antenna as claimed in claim 11, wherein the second antenna branch has a first section and a second section, a first end of the first section connecting to the foot portion and a second end of the first section connecting to a first end of the fourth section at a turning point, wherein a first distance between a second end of the second section and the ground connection is substantially equal to the gap.

18. A PIFA antenna comprising:

a first antenna branch, having a first turning point between a first end and a second end of the first antenna branch;

a second antenna branch being alongside to the first antenna branch and having a first gap with the first antenna branch therebetween, a first end of the second antenna branch connecting to the first end of the first antenna branch to form a series connection;

a ground connection arranged at a second end of the first antenna branch facing away from the first gap;

an RF supply connection arranged at the outer edge of the second end of the first antenna branch and located between the ground connection and the turning point, wherein a second end of the second antenna branch and the second end of the first antenna branch form an opening of the gap.

19. The PIFA antenna as claimed in claim 18, the first antenna branch further comprising:

a first section;

a second section connecting to the first section at the first turning point; and a foot section, a first end of the foot section connecting to the second section, a second end of the foot section connecting to the second antenna branch, wherein a length of the foot section is substantially equal to the gap.

20. The PIFA antenna as claimed in claim 19, the second antenna branch further comprising:

a third section connecting to the second end the foot section and being parallel to the second section;

a fourth section connecting the third section, wherein a first distance between the third section and the second section is substantially equal to a width of the gap.

21. The PIFA antenna as claimed in claim 20, wherein a second distance between the fourth section and the first section is substantially equal to the width of the gap.

* * * * *